US009519271B2

(12) United States Patent
Karapatis et al.

(10) Patent No.: US 9,519,271 B2
(45) Date of Patent: Dec. 13, 2016

(54) ACOUSTIC RADIATING MEMBRANE ARRANGEMENT FOR A STRIKING WATCH

(71) Applicant: Montres Breguet S.A., L'Abbaye (CH)

(72) Inventors: Polychronis Nakis Karapatis, Premier (CH); Davide Sarchi, Renens (CH); Younes Kadmiri, Morre (FR)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 14/879,288

(22) Filed: Oct. 9, 2015

(65) Prior Publication Data

US 2016/0109856 A1 Apr. 21, 2016

(30) Foreign Application Priority Data

Oct. 15, 2014 (EP) ..... 14189091

(51) Int. Cl.
*G04B 37/00* (2006.01)
*G04B 21/00* (2006.01)

(52) U.S. Cl.
CPC ..... *G04B 37/0075* (2013.01); *G04B 21/00* (2013.01)

(58) Field of Classification Search
CPC ..... G04B 37/0075; G04B 21/00
See application file for complete search history.

(56) References Cited

U.S. PATENT DOCUMENTS 4,180,970 A * 1/1980 Tokunaga ..... G04B 23/028 368/243
4,258,432 A * 3/1981 Zafferri ..... G04C 21/02 368/250
4,271,498 A * 6/1981 Zafferri ..... G04B 39/00 368/250
7,414,922 B2 * 8/2008 Ferri ..... G04B 37/0075 368/13
7,545,706 B2 * 6/2009 Candaux ..... G04B 21/08 368/243
8,540,420 B2 * 9/2013 Morata ..... G04B 21/12 368/315
8,638,644 B2 * 1/2014 Favre ..... G10K 13/00 368/272

(Continued)

FOREIGN PATENT DOCUMENTS

EP 1795978 A2 6/2007
EP 2461219 A1 6/2012

(Continued)

OTHER PUBLICATIONS

European Search Report of EP 14189091 dated Jun. 30, 2015.

*Primary Examiner* — Robert W Horn
(74) *Attorney, Agent, or Firm* — Sughrue Mion, PLLC

(57) ABSTRACT

There is provided an acoustic radiating membrane arrangement for a striking or musical watch. The arrangement includes a first membrane arranged superposed on a second membrane. Peripheral edge portions of the two membranes are intended to hold the membranes inside a watch case. The first acoustic radiating membrane is configured to radiate efficiently the frequencies in a first frequency band. The second acoustic radiating membrane is configured to radiate efficiently the frequencies in a second frequency band that is different from the first frequency band. A spacer ring is also disposed between the peripheral edge portions of the first membrane and of the second membrane to define an acoustic cavity.

17 Claims, 5 Drawing Sheets

(56) References Cited

U.S. PATENT DOCUMENTS

| | | | | |
|---|---|---|---|---|
| 8,665,676 | B2 * | 3/2014 | Sarchi | G10K 13/00 368/272 |
| 8,770,833 | B2 * | 7/2014 | Sciascia | G04B 37/0075 368/315 |
| 9,164,487 | B1 * | 10/2015 | Raggi | G04B 21/02 |
| 9,207,645 | B2 * | 12/2015 | Karapatis | G10K 1/07 |
| 9,360,843 | B2 * | 6/2016 | Kadmiri | G04B 21/02 |
| 9,417,611 | B2 * | 8/2016 | Karapatis | G04B 21/00 |
| 9,436,161 | B2 * | 9/2016 | Kadmiri | G04B 23/005 |
| 2012/0002513 | A1 * | 1/2012 | Behrend | G04B 37/052 368/286 |
| 2016/0098013 | A1 * | 4/2016 | Kadmiri | G04B 19/283 368/273 |
| 2016/0109856 | A1 * | 4/2016 | Karapatis | G04B 37/0075 368/272 |

FOREIGN PATENT DOCUMENTS

| | | | |
|---|---|---|---|
| EP | 2461220 | A1 | 6/2012 |
| FR | 2777095 | A1 | 10/1999 |

* cited by examiner

ACOUSTIC RADIATING MEMBRANE ARRANGEMENT FOR A STRIKING WATCH

This application claims priority from European patent application 14189091.3 filed Oct. 15, 2014, the entire disclosures of which is hereby incorporated herein by reference.

FIELD OF THE INVENTION

The invention concerns an acoustic radiating membrane arrangement for a musical watch, or a striking watch. This arrangement includes at least two membranes superposed inside the watch case for the acoustic radiation of a sound generated in the watch.

BACKGROUND OF THE INVENTION

In a watch, a striking mechanism may be provided to generate a sound or piece of music. To achieve this, the gong of the striking watch or the vibration plate of the musical watch are generally arranged inside the watch case. Thus, the vibrations of the gong or the vibration plate strips are transmitted to the various external parts of the watch. These external parts are, for example, the case middle, the bezel, the crystal and the back cover of the watch case. These large external parts start to radiate sound into the air under the effect of the transmitted vibrations. When a sound is produced either by a gong struck by a hammer, or by the vibration of one or more strips of the vibration plate, these external parts are capable of radiating the produced sound into the air.

Generally, in such a musical or striking watch, acoustic efficiency, based on the complex vibroacoustic transduction of the external parts, is low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

The frequency content of the sound from a striking or musical watch must be rich in a frequency range between 1 kHz and 6 kHz. Conventional external parts do not allow efficient radiation in this frequency range. Thus, in order to further improve the vibroacoustic efficiency of the striking mechanism, one or more membranes are arranged inside the watch case. The membranes are dimensioned and configured such that the note or notes produced in the watch case are efficiently radiated. The frequencies of the notes produced must be close to the natural vibration modes of the membranes in order for them to resonate.

Constraints relating to the arrangement of acoustic membranes are generally at variance with the rules of mechanical design for ensuring impermeable sealing, and the mechanical resistance of the watch to shocks and high external pressures. The back cover of the striking or musical watch, which is normally pierced with openings, also requires the connection between the membrane or membranes and the rest of the movement to be sealed. In these conditions, a pierced membrane cannot therefore be used between the back cover and the mechanical movement. Further, a membrane having a too low level of stiffness cannot ensure sufficient resistance to external pressure without risking damage to the movement, which constitutes drawbacks.

EP Patent Application No 1 795 978 A2 discloses a watch, which includes a striking device. This striking device includes two bell-shaped membranes, which are coaxially held in the watch case, one atop the other, by central support pins. There is also provided, between the two bells and the back cover of the watch case, another thin taut membrane secured between the case middle and the pierced back cover of the watch case. By adjusting the radial tension of the other membrane, it is possible to adjust the acoustic radiation frequency of this membrane. However, the two other bell-shaped membranes are not arranged to improve the acoustic level of the sound produced by the striking device, which is a drawback.

SUMMARY OF THE INVENTION

It is therefore an object of the invention to overcome the aforementioned prior art drawbacks by providing an acoustic radiating membrane arrangement for a musical watch or a striking watch, created to improve acoustic efficiency over a broad frequency range and also to ensure the impermeable sealing and resistance to high external pressure of the watch case.

To this end, the invention concerns an acoustic radiating membrane arrangement for a striking or musical watch, the arrangement including a first membrane arranged superposed on a second membrane, a first peripheral edge portion of the first membrane and a second peripheral edge portion of the second membrane being intended to hold the membranes inside a watch case, the first acoustic radiating membrane being configured to radiate efficiently the frequencies in a first frequency band, and the second acoustic radiating membrane being configured to radiate efficiently the frequencies in a second frequency band that is different from the first frequency band, wherein a spacer ring is disposed between the first membrane and the second membrane to define a cavity between the two membranes, which is tuned to at least one of the two natural vibration frequencies of the two membranes.

Particular embodiments of the acoustic radiating membrane arrangement are defined in the dependent claims 2 to 18.

One advantage of the acoustic radiating membrane arrangement lies in the fact that the geometry and connection of several, notably superposed membranes are each specifically optimised to guarantee mechanical strength and impermeable sealing, and also to improve and make uniform acoustic radiation, mainly in a frequency band from 1 kHz to 4 kHz.

Advantageously, at least a first membrane is configured to radiate efficiently the frequencies in a first frequency band, which may be the frequency band from 2 kHz to 4 kHz. This first membrane, secured inside the watch case, ensures good sealing of the portion of the watch case that includes the mechanical movement of the striking or musical watch. This acoustic membrane is made of a determined material and with a defined general width having plan dimensions comparable to the plan dimensions of a watch case or crystal.

Advantageously, at least a second membrane is configured with a central portion in the form of a piston, similar to the principle of a loudspeaker. Openings may also be made in the central portion. This makes it possible to ensure an increase in vibration amplitude, especially in a second frequency band, which may be a frequency band from 1 kHz to 2 kHz. As with the first membrane, this second acoustic membrane is made of a determined material and with a defined general width having dimensions that may be comparable to those of the first membrane. The acoustic response of the second membrane is relatively uniform in this frequency range.

Advantageously, the second membrane is superposed on the first membrane, for example by means of a spacer ring. Owing to the assembly of the two membranes with the spacer ring, there remains a cavity between the two membranes, which is tuned, to within 100 Hz, to one of the two fundamental vibration frequencies of the two membranes. Further, the openings, which are made in the central portion of the second membrane, may be dimensioned such that the assembly of the two membranes provides an acoustic cavity of the Helmholtz resonator type. This allows the acoustic level of the striking or musical watch to be increased at certain frequencies.

Advantageously, the membrane arrangement, which is preferably formed of two membranes and the spacer ring, can be made as a single piece.

Advantageously, at least one of the two membranes may be made in a material having a Young's modulus E>60 GPa and E<150 GPa and a density comprised between 5,000 and 18,000 kg/cm$^3$, of amorphous metal or metallic glass, or also of gold or platinum, or even of brass or titanium.

Advantageously, the two membranes are made of two materials having the same Young's modulus to density ratio.

Advantageously, at least one of the two membranes has an elastic limit greater than 1 GPa.

With such membranes, extension of the sound range can be combined with very low internal damping, which makes it possible to obtain very good acoustic efficiency.

BRIEF DESCRIPTION OF THE DRAWINGS

The objects, advantages and features of the acoustic radiating membrane arrangement for a musical watch or a striking watch will appear more clearly in the following description given on the basis of at least one non-limiting embodiment, illustrated by the drawings, in which.

DETAILED DESCRIPTION OF THE INVENTION

In the following description, reference will mainly be made to the configuration of the acoustic radiating membrane arrangement intended to equip a musical watch, or a striking watch. The acoustic radiating membranes may be made in a complex shape to increase the vibration amplitude of the various notes produced in a watch case. Preferably, the membranes are dimensioned and configured to amplify, in particular, the first vibration mode, or even a second vibration mode, in a frequency band from 1 kHz to 4 kHz.

Figure 1A:
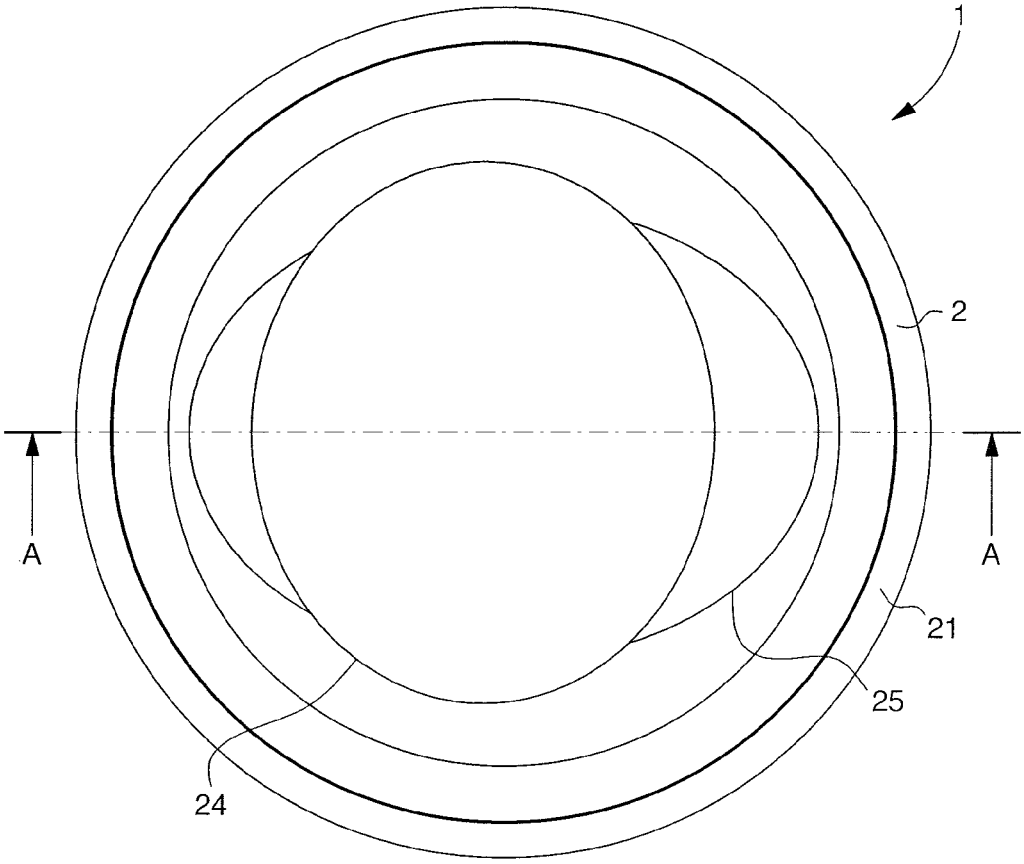
FIGS. 1*a* and 1*b* show a top plan view and an exploded diametrical sectional view along A-A of FIG. 1*a* of one embodiment of the acoustic radiating membrane arrangement according to the invention.
Figure 1B:
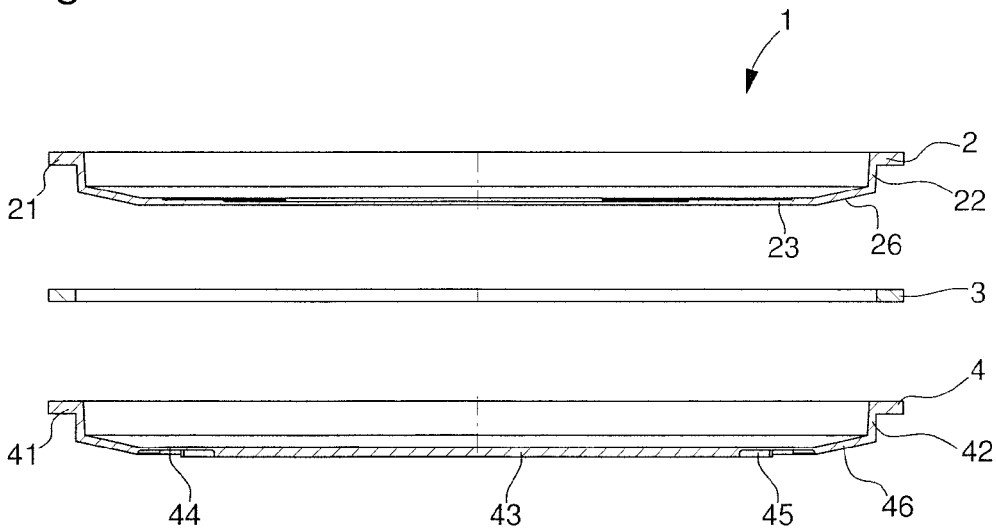
Figure 2:
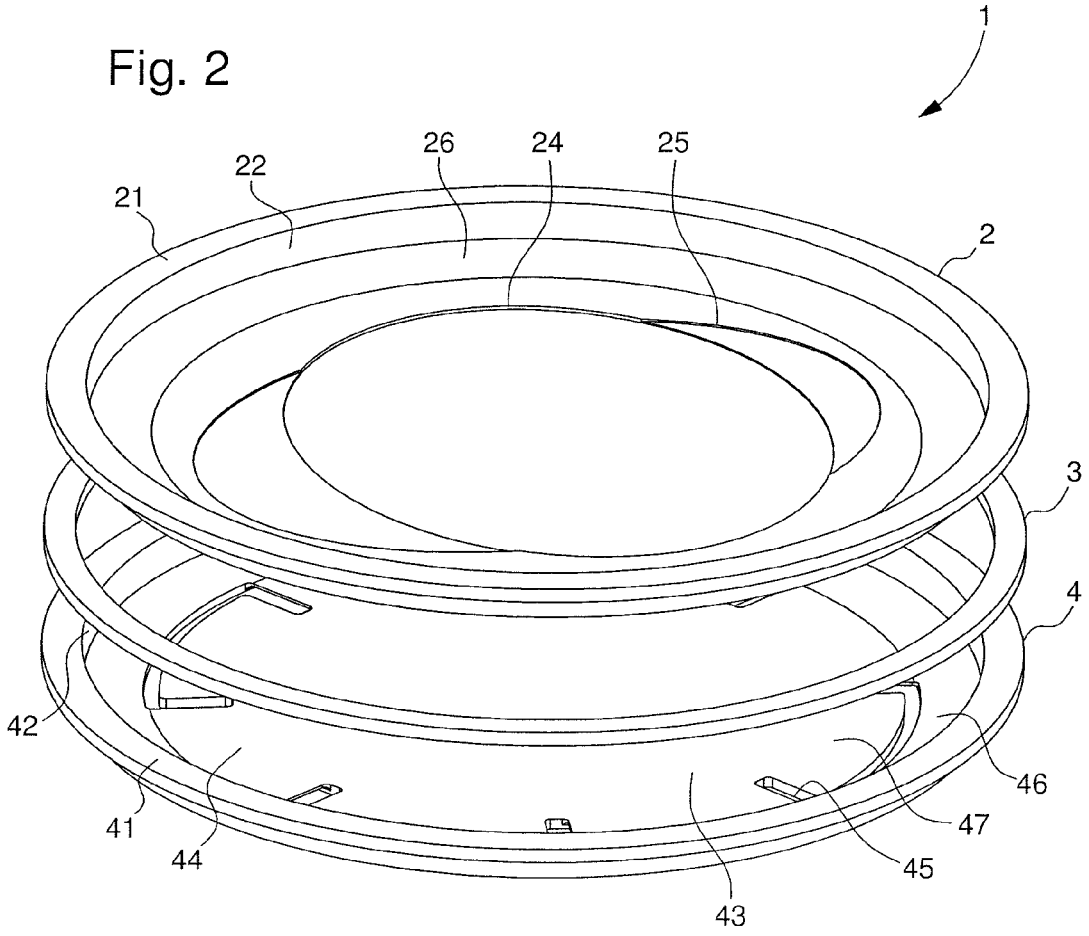
FIG. 2 shows an exploded three-dimensional view of the acoustic radiating membrane arrangement according to the invention.

FIGS. 1*a*, 1*b* and 2 show an embodiment of the acoustic radiating membrane arrangement 1, which may equip a musical watch or a striking watch. Depending on the shape of the watch case, the acoustic radiating membrane arrangement 1 may, seen from above, have a generally rectangular, or polygonal, or preferably circular shape, as shown in FIG. 1*a*.

The acoustic radiating membrane arrangement 1 includes at least a first acoustic membrane 2 superposed on a second acoustic membrane 4. Preferably, the first membrane 2 is superposed on the second membrane 4 by means of a spacer ring 3 thereby defining an acoustic cavity. The two superposed membranes 2, 4, are dimensioned to be held, for example, clamped during their assembly in a watch case, between the back cover and the middle part of the watch case with a sealing gasket at the periphery of the membranes. The plan dimensions of these membranes may be comparable to the inner dimensions of the watch case or of the watch crystal.

The first membrane 2 is dimensioned and configured to radiate efficiently the frequencies in the frequency band from 2 kHz to 4 kHz of sounds or notes produced by the striking or musical mechanism of the watch. Preferably, for assembly in a watch case of generally circular shape, seen from above, this first membrane 2 defines a disc. The first membrane 2 takes the form, for example, of a dome with an active central portion 23, 26, defining a dome base, a cylindrical or even slightly conic lateral wall 22, and a peripheral edge portion 21.

Starting from its connection to lateral wall 22, central portion 23, 26 may have a diameter greater than 15 mm and preferably between 20 and 40 mm. This diameter may be substantially equivalent to that of a watch crystal (not shown). Conventionally, the peripheral edge portion 21 may be clamped between a peripheral support of the back cover of the watch case and a circular inner rim of the case middle by means of at least one sealing gasket. The general thickness of first membrane 2 is less than or equal to 1 mm.

Central portion 23, 26 of first membrane 2 includes a base 23 defining a preferably circular and flat bottom, and an annular portion 26 at the periphery of base 23, so as to form a single piece. The diameter of base 23 may be between 10 and 20% less than the diameter of annular portion 26. Annular portion 26 may be slightly tapered at an angle of between 70° and 88°, preferably on the order of 86°, with respect to the axis of the base.

The first membrane 2 is made with no pierced portions or openings through the material of the membrane. This ensures good sealing of the portion of the watch case that includes, in particular, the timepiece movement with the striking or musical mechanism.

It is also possible to provide hollow areas 24, 25 of different thickness in base 23. Seen from above, these hollow areas 24, 25 have asymmetrical circular shapes, such as ellipses. With these ellipses 24, 25, it is possible to have twice the number of natural vibration modes for each ellipse compared to an area of uniform circular shape. This type of embodiment of first membrane 2 with a base 23 provided with a first hollow area 24 and with a second hollow area 25, is described in detail with reference to FIG. 1 in EP Patent Application No 2 461 219 A1, which is incorporated herein by reference.

Of course, it is also possible to provide protruding portions (not shown) of different thickness in base 23, as explained in EP Patent Application No 2 461 219 A1. These protruding portions may also be ellipses to obtain a large number of natural vibration modes for first membrane 2.

Second membrane 4 is dimensioned and configured to radiate efficiently the frequencies in the frequency band from 1 kHz to 2 kHz of sounds or notes produced by the striking or musical mechanism of the watch. As with the first membrane 2, seen from above, second membrane 4 defines a disc, whose shape and dimensions may be similar to those of the first membrane, as explained above. Second membrane 4 may also be configured in the form of a dome with an active central portion 43, 46 defining a dome base. Second membrane 4 also includes a lateral wall 42 of cylindrical or even slightly conic shape, connected to the central portion, and a peripheral edge portion 41 for the superposed assembly thereof to first membrane 2 inside the watch case.

The active central portion of second membrane 4 is formed of a base 43, connected to an annular portion 46, so as to form a single piece. As with first membrane 2, the base 43 of second membrane 4 defines a preferably circular and flat base. The diameter of base 43 may be between 10 and 20% less than the external diameter of annular portion 46. Annular portion 46 may be slightly tapered at an identical angle to annular portion 26 of first membrane 2.

One or more pierced portions or openings 45 are made in the central portion, notably in base 43 of second membrane 4. These pierced portions or openings 45 may be U-shaped, while defining suspended surfaces or sectors 47 that are partially connected to base 43. The arms of the U-shaped openings are oriented towards the centre of base 43. Each base of the U-shaped pierced portions is disposed on an imaginary circle concentric to base 43. Thus, base 43 of the second membrane is connected to annular portion 46 by means of one or more connecting sectors 44. These connecting sectors 44 are made in the material of base 43 with a smaller thickness than the rest of the base to enhance the vibration of the membrane.

In the embodiment shown in FIG. 2, the central portion may include four connecting sectors 44, which are regularly spaced from each other. The suspended sectors 47 are thus also regularly spaced from each other. The angle of each sector 44 determined from the centre of central portion 43 may be identical to the angle described by the base of each opening 45. In these conditions, each sector 44 and each opening 45 are defined at an angle of 45°. However, the angle of each sector may also be different from the angle of each opening and the number thereof may be different from 4.

The thickness of each sector 44 may be chosen to be between 50 and 100 μm, whereas the thickness of the rest of base 43 may be greater than 100 μm and less than 1 mm. Thus, the central portion of second membrane 4 may take the form of a piston, similar to the principle of a loudspeaker, which improves acoustic radiation notable in the frequency band from 1 kHz to 2 kHz.

The two acoustic radiating membranes 2 and 4 may be formed in a single piece made of the same material, which may be metallic. This material may be amorphous metal or metallic glass. The material selected may also be gold, or platinum, or even brass, titanium, aluminium, for example with a similar density, Young's modulus and elastic limit.

It is also possible to envisage to design each membrane by combining two different materials, by soldering, brazing, pressing-in or coating. First membrane 2 may be made of a different material from second membrane 4, but in order to obtain good acoustic radiation at any temperature, the temperature dependence of the selected materials must be close.

As specified above, the membrane arrangement 1 also includes a spacer ring 3 disposed during assembly between first membrane 2 and second membrane 4. This ring may be made of an equivalent material to the first membrane and/or the second membrane. Membrane arrangement 1 may also be made in a single piece.

Ring 3 may advantageously have an equivalent diameter to the external diameter of each membrane. This facilitates the assembly of membrane arrangement 1 in a watch case with the peripheral edge portion 21, 41 of each membrane 2, 4 and spacer ring 3 properly aligned. After assembly of membrane arrangement 1 in the watch case, the central portions 23, 43 of the two membranes 2, 4 are not in contact with each other and with other parts of the watch in order to vibrate freely.

Once the first membrane 2, spacer ring 3 and second membrane 4 are mounted, there remains a cavity between the two membranes. This cavity may be tuned to one of the two natural vibration frequencies of the two membranes. Further, openings 45, which are made in the central portion of second membrane 4, and the thickness of the spacer ring, which may be close to 1 mm, may be dimensioned such that the assembly of the two membranes provides the acoustic cavity of the Helmholtz resonator type. In such case, the system provides a vibroacoustic coupling between the membranes and the cavity. This allows the acoustic level of the striking or musical watch to be increased at certain frequencies.

It should also be noted that parts of the peripheral edge portions 21, 41 of membranes 2, 4 may be arranged to rest on the movement or on an inner rim of the case middle. In such case, the peripheral edge portions 21, 41 are no longer placed one atop the other, but fitted together. The portions formed at the periphery of the membranes may have a defined geometry to improve the vibration transfer between a sound generator and the membranes.

It should also be noted that second membrane 4 may be configured in a different manner from that described with reference to FIGS. 1*a*, 1*b* and 2. First membrane 2 and second membrane 4 may be made with no pierced and/or transparent parts. The thickness of the central portion of one or other membrane may also vary from the centre towards the exterior of each membrane.

Figure 3:
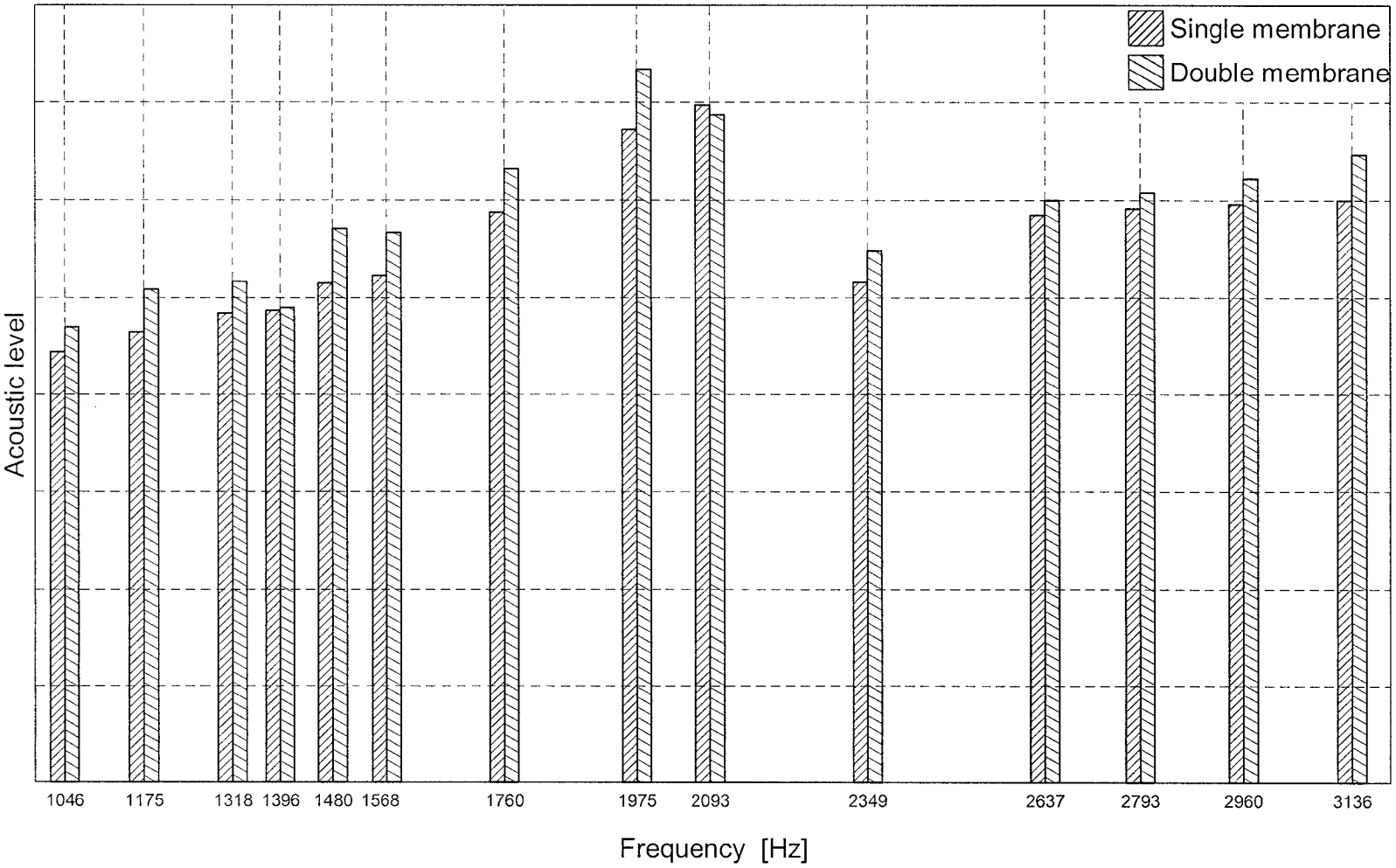
FIG. 3 shows a graph of the measured acoustic level for a single membrane in comparison to an arrangement with two membranes according to the invention, as a function of the activation frequencies of a sound generator of the striking or musical watch.

By way of illustration, FIG. 3 shows the acoustic level measured as a function of the activation frequencies imparted by a vibration generator of the watch. This could be, for example, the 1st natural mode frequencies of the vibration plate strips of a striking mechanism. A comparison is shown between the utilisation of a conventional geometrically optimised membrane mounted in the watch case, and utilisation of the two-membrane arrangement of the present invention.

Test results prove the utility of the arrangement with at least two membranes to improve the acoustic radiation of a striking mechanism. The acoustic level obtained using this arrangement of membranes is increased throughout the frequency band and more at lower frequencies, except at one frequency, which coincides with the anti-resonance of the coupled membrane-cavity system. The presence of anti-resonance demonstrates the vibroacoustic coupling between the components.

Figure 4:
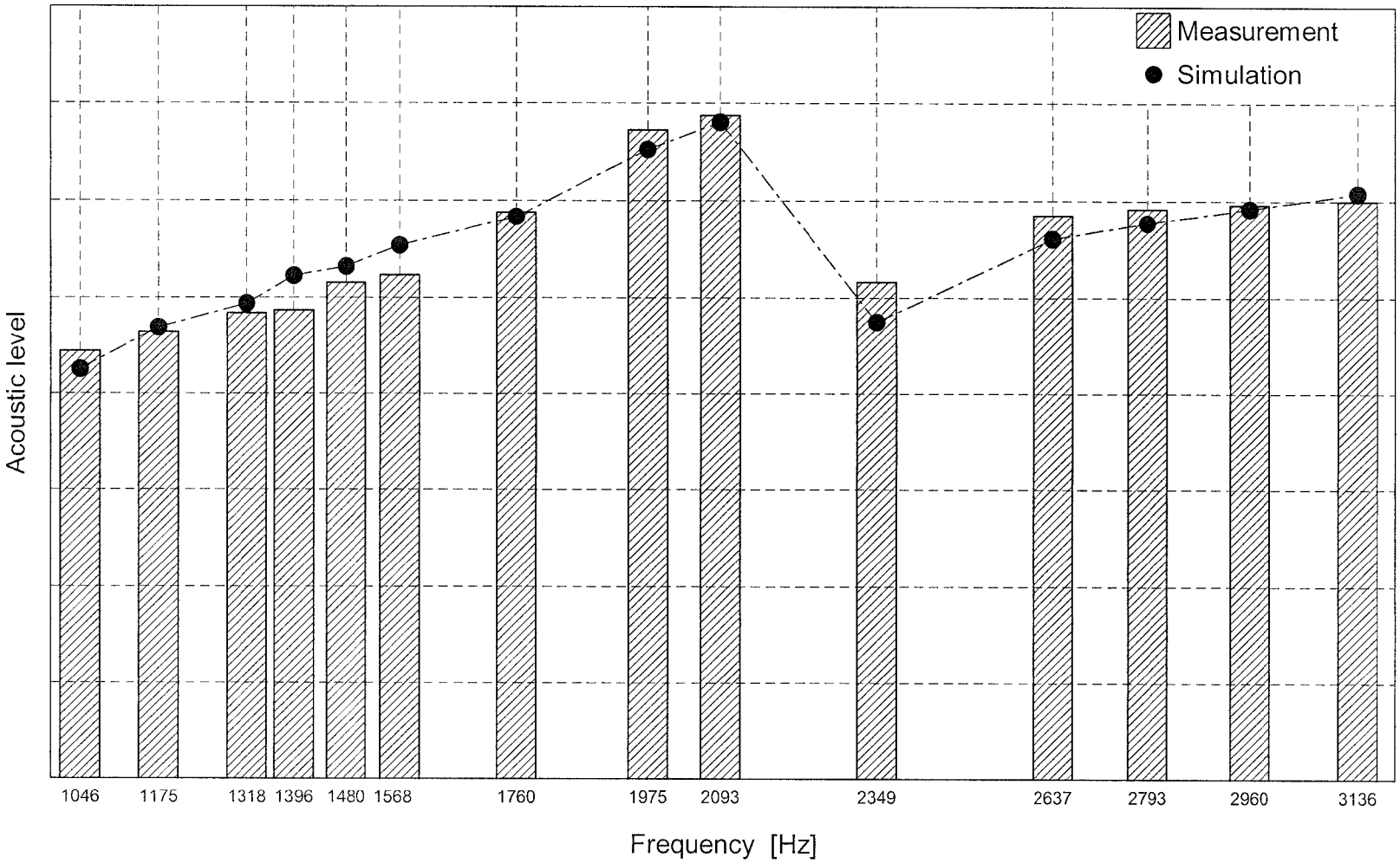
FIG. 4 shows a graph of the comparison between the acoustic level measured and obtained by simulation in the case of a conventional single membrane.
Figure 5:
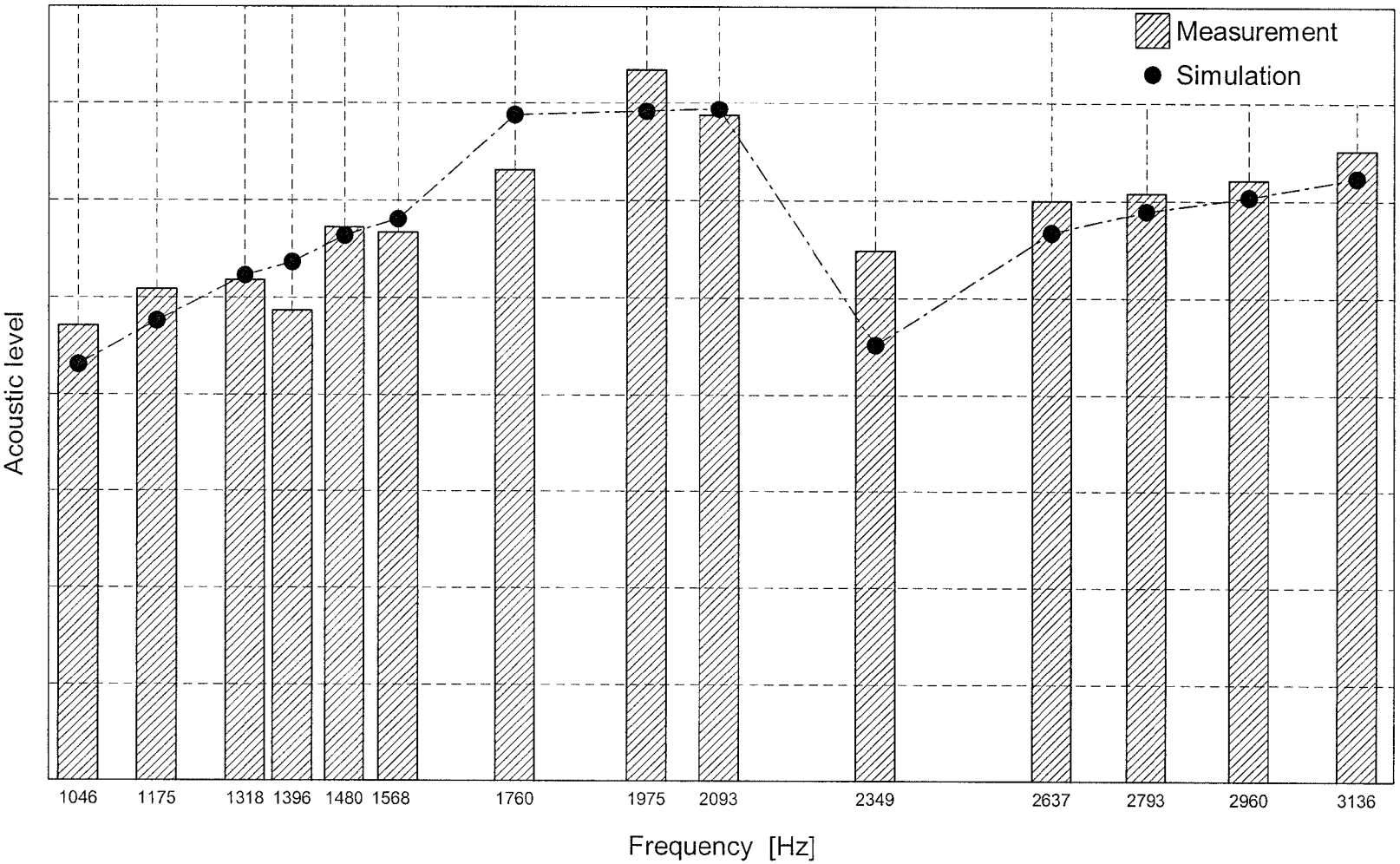
FIG. 5 shows a graph comparing the acoustic level measured to that obtained by simulation in the case of an arrangement with two membranes according to the invention.

By way of illustration, FIGS. 4 and 5 show comparisons between measurements of the acoustic level in the frequency range of the notes or sounds produced and the results from a simulation. FIG. 4 shows the case of a single membrane, whereas FIG. 5 shows the case of the membrane arrangement of the present invention.

Since the function and performance of the membrane arrangement can be digitally simulated, it is possible to obtain theoretical dimensions of the arrangement and its performance is not dependent on its assembly, which differs from other external parts. Development of a digital model makes it possible to be predictive. It is also possible to optimise parameters, such as the bearing of the membranes on the movement, the dimensions of the pierced portions of the second membrane and the geometries of the two membranes.

From the description that has just been given, several variants of the membrane arrangement for a striking or musical watch can be devised by those skilled in the art without departing from the scope of the invention defined by the claims. Pierced portions of various dimensions may be provided in the second membrane at different locations, for example from the centre towards the exterior of the membrane. More than two superposed and assembled membranes may be provided.

What is claimed is:

1. An acoustic radiating membrane arrangement for a striking or musical watch, the arrangement including a first membrane arranged superposed on a second membrane, a first peripheral edge portion of the first membrane and a second peripheral edge portion of the second membrane being intended to hold the membranes inside a watch case, the first acoustic radiating membrane being configured to radiate efficiently the frequencies in a first frequency band, and the second acoustic radiating membrane being configured to radiate efficiently the frequencies in a second frequency band that is different from the first frequency band, wherein a spacer ring is disposed between the first membrane and the second membrane to define a cavity between the two membranes, which is tuned to at least one of the two natural vibration frequencies of the two membranes.

2. The acoustic radiating membrane arrangement according to claim 1, wherein the first membrane is configured to radiate efficiently in a frequency band between 2 kHz and 4 kHz, and wherein the second membrane is configured to radiate efficiently in a frequency band between 1 kHz and 2 kHz.

3. The acoustic radiating membrane arrangement according to claim 1, wherein the first membrane is configured in the form of a dome with a central portion connected to a lateral wall, which is connected to the first peripheral edge portion.

4. The acoustic radiating membrane arrangement according to claim 3, wherein the lateral wall is of cylindrical shape.

5. The acoustic radiating membrane arrangement according to claim 4, wherein the central portion includes a base defining a bottom, and an annular portion at the periphery of the base so as to form a single piece.

6. The acoustic radiating membrane arrangement according to claim 5, wherein the base is of circular flat shape, and wherein the annular portion is conic.

7. The acoustic radiating membrane arrangement according to claim 3, wherein the central portion includes at least a first hollow area in the form of an ellipse.

8. The acoustic radiating membrane arrangement according to claim 7, wherein the central portion includes two elliptical hollow areas, which are of different thickness.

9. The acoustic radiating membrane arrangement according to claim 1, wherein the second membrane is configured in the form of a dome with a central portion connected to a lateral wall, which is connected to the second peripheral edge portion.

10. The acoustic radiating membrane arrangement according to claim 9, wherein the lateral wall is of cylindrical shape.

11. The acoustic radiating membrane arrangement according to claim 9, wherein the central portion includes a base defining a bottom, and an annular portion at the periphery of the base so as to form a single piece.

12. The acoustic radiating membrane arrangement according to claim 11, wherein the base is of circular flat shape, and wherein the annular portion is conic.

13. The acoustic radiating membrane arrangement according to claim 9, wherein the base of the second membrane includes one or more pierced portions or openings.

14. The acoustic radiating membrane arrangement according to claim 13, wherein the pierced portions or openings define suspended sectors, which are U-shaped, and whose arms are oriented towards the centre of the base.

15. The acoustic radiating membrane arrangement according to claim 13, wherein the base of the second membrane is connected to an annular portion of the central portion by means of connecting sectors, and wherein the connecting sectors are made in the material of the base with a thickness reduced by a factor of at least two compared to the central portion of the base.

16. The acoustic radiating membrane arrangement according to claim 15, wherein the central portion includes four connecting sectors, which are regularly spaced from each other, with one pierced portion between two successive sectors.

17. The acoustic radiating membrane arrangement according to claim 1, wherein at least one of the two membranes is transparent.

* * * * *